United States Patent [19]

Aguillen, Jr. et al.

[11] Patent Number: 4,796,347

[45] Date of Patent: Jan. 10, 1989

[54] PLASTIC-PIPE PULLING TOOL

[76] Inventors: Domingo V. Aguillen, Jr., 7485 Fillmore Dr.; Pete P. Casares, 6324 Sherman Way; John E. DeForrest, 7152 El Veloz Way, all of Buena Park, Calif. 90620; Kevin C. Green, 6425 Belen Ave., Long Beach, Calif. 90815; Rocque A. Kavanagh, 4238 61st St., Los Angeles, Calif. 90043; Bryan Wilkinson, 4113 169th St., Lawndale, Calif. 90260; Marc K. Marks, 2507 Feijoa Ave., Lomita, Calif. 90717; Gerardo Zuñiga, 24511 Albatross Ave., Wilmington, Calif. 90744

[21] Appl. No.: 113,064

[22] Filed: Oct. 27, 1987

[51] Int. Cl.[4] ..... F16G 11/05

[52] U.S. Cl. ..... 29/280

[58] Field of Search ..... 294/15, 1.1; 72/705, 72/119; 29/280, 264, 263, 234

[56] References Cited

U.S. PATENT DOCUMENTS

| | | | |
|---|---|---|---|
| 3,635,072 | 1/1972 | Steinmann | 72/705 |
| 3,744,291 | 7/1973 | Hagerty et al. | 72/705 |
| 3,922,902 | 12/1975 | Jarman | 72/705 |
| 4,034,594 | 7/1977 | Morgan | 72/705 |
| 4,089,201 | 5/1978 | Raptis | 72/705 |
| 4,432,663 | 2/1984 | Lasak et al. | 294/1.1 |
| 4,557,513 | 12/1985 | Ferrieri | 294/1.1 |

*Primary Examiner*—Robert C. Watson

*Attorney, Agent, or Firm*—Bruce L. Birchard

[57] ABSTRACT

A plastic-pipe puller tool for installing subterranean utility pipes has a shaft portion, one tapered end on the shaft portion for snugly fitting within the inner wall of the plastic pipe to be installed and a second coupling end which may have a coupler which is rotatably supported from the shaft portion, to permit rapid and easy joining of the plastic pipe to the pipe-pulling means, whether a bore-pipe or a pneumatic hose.

5 Claims, 1 Drawing Sheet

PLASTIC-PIPE PULLING TOOL

BACKGROUND OF THE INVENTION

1. Field of the Invention

This invention relates to underground utility pipe installation apparatus and, more particularly, to pipe pullers for plastic utility pipes.

2. Prior Art

In installing utility pipes, for example heating gas pipes from the mains into the individual houses, it is necessary to bore a passageway for the pipe through the earth since all such pipes are subterranean. A bore-pipe is used for this purpose and after it completes the job of boring the tunnel for the utility pipe, it is the practice to connect a pipe to the boring tool in preparation for pulling the pipe through the tunnel which has been formed so that when the bore-pipe is withdrawn the utility pipe is drawn into the opening formed by the bore-pipe. In the past, this has been accomplished with what is known as a "Kellum" puller. The "Kellum" puller has a wire mesh "Chinese finger" which grips the utility pipe as it is pulled back through the pipe-bore-hole. Field experience has shown that the "Kellum" puller, because of the mesh construction of the puller permits dirt to pass into the utility pipe, thus restricting the flow of gas or other fluid through the pipe and the wire mesh which makes up the puller also becomes frayed and difficult to handle. That wire mesh may become coated with mud in some cases during the pulling process and when that occurs the cleaning process for the tool may be difficult and time-consuming. In sandy soils the mesh, which forms the conventional puller, can become packed with sand which, again, causes difficulty in pulling the utility pipes through the bore-hole.

Furthermore, with the conventional or "Kellum" puller, there is no specific means provided for attaching the locating wire which must accompany the plastic pipe when it is installed as a utility pipe. This locating wire is necessary so that, in the event of an emergency, an electronic detector may be utilized to locate the utility pipe in the ground. Of course, when leakage of the utility pipe occurs, finding and repairing that pipe is vital.

Furthermore, in connection with the boring-tool known as the "Accupunch" tool, there is no attachment provided for pulling the utility pipe through the bore-hole formed by the Accupunch tool. An Accupunch tool is one which uses compressed air to force the nose of the tool forward, forming a bore-hole. This tool, which relies upon the use of compressed air to compress the soil and form the bore-hole, is only appropriate in certain soil, such as sandy loam, which is not densely packed. When the Accupunch tool, or its equivalent, is used, the plastic pipe is taped directly to the air hose, along with the locating wire, and the utility pipe and the locating wire are pulled back through the bore as the compressed-air tool is removed from the bore. The attachment of the pipe and the locating wire to the Accupunch tool is sometimes difficult and time-consuming.

Therefore, it is an object of this invention to provide an improved puller for plastic utility pipes.

It is a further object of this invention to provide an improved puller for plastic utility pipes which saves time in its use and assures maximum performance of the utility pipe after it is installed under the ground.

SUMMARY OF THE INVENTION

A plastic pipe puller is provided which, at one end, is adapted to be coupled to the bore-pipe and at the other end is tapered and carries helically disposed ridges, the maximum diameter of the tapered section being such as to form a snug fit with the inner wall of the plastic utility-pipe to be pulled. In one embodiment the bore-pipe connecting end of the tool is rotatably coupled to the tapered portion to permit ease of coupling to both the bore-pipe and the plastic pipe to be pulled. In both embodiments, means are provided for easily attaching the locator wire which is pulled through the bore hole with the plastic utility pipe. Use of a pulling tool of the type claimed herein reduces by a factor of three the time required to connect the plastic pipe to the pipe puller.

BRIEF DESCRIPTION OF THE DRAWING

This invention and its mode of operation can best be understood by reading the description which follows in conjunction with the drawings herein, in which.

DETAILED DESCRIPTION OF THE PREFERRED EMBODIMENT

Figure 1:
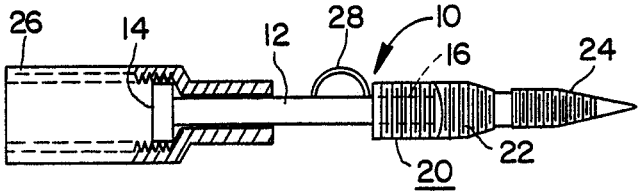
FIG. 1 is an elevation view, partially cross-sectioned, showing one embodiment of the pulling tool according to this invention.
Figure 2:
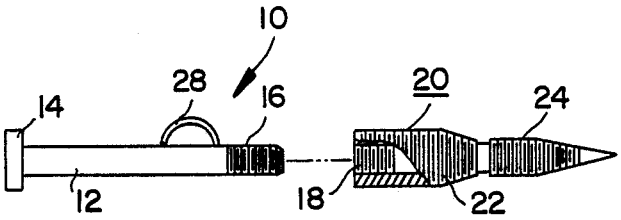
FIG. 2 is an exploded view of a portion of the pulling tool of FIG. 1; and, FIG. 3 is an elevational view of a second embodiment of a pulling tool, according to this invention.

In FIG. 1, pulling-tool 10 includes bolt or shaft portion 12 which terminates at one end in cap 14 and at the other end (as can be seen more clearly in FIG. 2) in a threaded section 16. Threaded section 16 is received by the internally-threaded opening 18 in plastic-pipe coupling section 20, which has a first portion 22 which carries helical threads, the outer diameter of which is such as to permit a snug coupling of portion 22 with the inner wall of one half inch IPS plastic pipe. Portion 24 of plastic-pipe coupling section 20 is tapered, as shown, and carries thereon a helical thread the maximum diameter of which is such as to couple snugly to the inner walls of a one-half inch CTS plastic pipe. Bore-pipe coupler 26 carries internal threads therein which are sized and pitched to cooperate with the male threads on a standard bore-pipe for half-inch plastic pipe. Coupler 26 is free to rotate around rod 12 with its cap 14. Plastic-pipe coupling section 20, on the other hand, does not rotate freely about rod 12 once it is applied to that rod. Thus, it is possible to install plastic-pipe coupling section 20 in the plastic-pipe to be pulled and following that step it is then possible to couple, without difficulty, bore-pipe coupling section 26 to the bore-pipe which has formed the bore-hole for the plastic utility pipe.

Loop 28 is welded to shaft or rod 12 at both of its ends to permit the attachment of a locator wire which must, necessarily, be pulled through the bore-hole simultaneously with the pulling of the plastic utility pipe.

Figure 3:
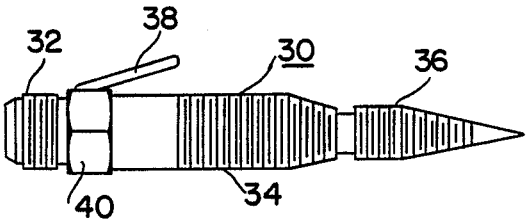

In FIG. 3, pulling tool 30 includes threaded coupling section 32, which is sized and pitched to couple to the pneumatic hose which has been used in connection with the formation of the bore-hole by pneumatic driver means, threaded plastic pipe coupler portion 34 which is adapted for forming a snug fit with the inner wall of, for example, one half inch IPS plastic pipe and tapered plastic pipe coupling section 36 of which is such as to form a snug fit with the inner wall of, for example, one half inch CTS plastic pipe. Pulling tool 30 is provided with loop 38 to which a locating wire may be connected for pulling with the plastic pipe into the bore-hole. A hexnut portion 40 may also be provided to permit the snug fitting of threaded coupler section 32 into the pneumatic hose with which it will be pulled through the bore-hole.

While particular embodiments of this invention have been shown and described, it will be apparent to those skilled in the art that modifications and variations may be made therein without departing from the spirit and scope of the invention. It is the intention of the appended claims to cover all such modifications and variations.

What is claimed is:

1. A puller tool for installing plastic utility pipe having either first or second inner-wall diameters, including:

a shaft portion;

a bore-pipe coupler carried by said shaft portion at the first end thereof;

a utility-pipe coupler carried by said shaft portion at the opposite end thereof, said utility-pipe coupler having first and second coupling sections, the maximum outside diameter of said first coupling section being such as to form a snug fit with the inner-wall of said utility pipe of said first inner-wall diameter, said second coupling section having a maximum outside diameter which is such to form a snug fit with the inner-wall of said utility pipe of said second inner-wall diameter, said first coupling section being closer to said bore-pipe coupler than is said second coupling section;

said first and second coupling sections having tapered segments and carrying threads along at-least-a-portion of such tapered segments; and, a location-wire connector loop fixedly carried by said shaft.

2. Apparatus according to claim 1 in which said bore-pipe coupler is carried rotatably by said shaft.

3. Apparatus according to claim 1 in which said bore-pipe coupler is hollow and internally threaded.

4. Apparatus according to claim 1 in which said shaft carries a head at said first end thereof capturing said bore-pipe coupler.

5. Apparatus according to claim 1 in which said bore-pipe coupler is sized and threaded to cooperate with a pneumatic hose.

* * * * *